PAINT ROLLER PAN

This is a continuation, of application. Ser. No. 506,741, filed Sept. 16, 1974, now abandoned.

BACKGROUND OF THE INVENTION

When using a typical paint roller to apply paint to a surface, a paint roller pan is used to hold a supply of paint for application by the paint roller, since the paint roller is normally of too great a width to be dipped into a paint can. Also, there is the need to roll the paint roller on some type of surface in order to evenly distribute the paint on the roller surface for more uniform application to a wall or work surface.

A paint roller normally can apply paint more quickly to a surface because of its greater width as compared to most brushes. However, when painting a room containing a number of walls and a ceiling, the paint roller is too large and awkward to apply the paint in borderline areas adjacent corners and window or door frames. These areas require touch-up work to be performed using a typical brush which allows for the application of paint in the more difficult areas.

When using a brush for touch-up work, the painter must either dip the brush into the paint supply within the can or into the same paint reservoir in the paint roller pan used by the paint roller. Many times the painter is up on a ladder or in an awkward position which makes it undesirable to have both the paint can and a paint roller pan in the same work area. Therefore, many painters utilize the flat reservoir of paint in the paint pan for the paint supply to be used on a brush. This poses somewhat of a problem, since the paint in the paint pan is of shallow depth, requiring the painter to incline the paint brush in order to place enough paint on his brush. Also, when using the reservoir which is designed for use by the paint roller, it is necessary to move the paint roller which is usually resting temporarily in that area.

Once the use of the paint brush has been completed the painter is faced with the problem of where to temporarily store the paint brush while he again returns to use of the paint roller.

SUMMARY OF THE INVENTION

The paint roller pan invention as disclosed herein includes a separate paint receptacle or reservoir for the paint roller and the paint brush. The receptacle for the paint brush also acts as a leg to maintain a portion of the bottom surface of the pan at an incline angle with a horizontal or flat surface.

The inclusion of a separate paint reservoir for use by a paint brush allows a painter a more convenient arrangement to utilize both the paint roller and the paint brush in conjunction with a single unit for containing the paint necessary to perform the work. When the painter has completed the use of the paint brush temporarily, he can place the paint brush in the same reservoir which holds the paint for the paint brush, alleviating the problem of where to place the paint brush when the painter is utilizing the paint roller. The paint brush reservoir acts as a leg to support one end of the pan, so that part of the bottom portion of the pan is at an incline for use by the paint roller to evenly spread the paint on the roller surface.

DETAILED DESCRIPTION OF THE INVENTION

Figure 1:
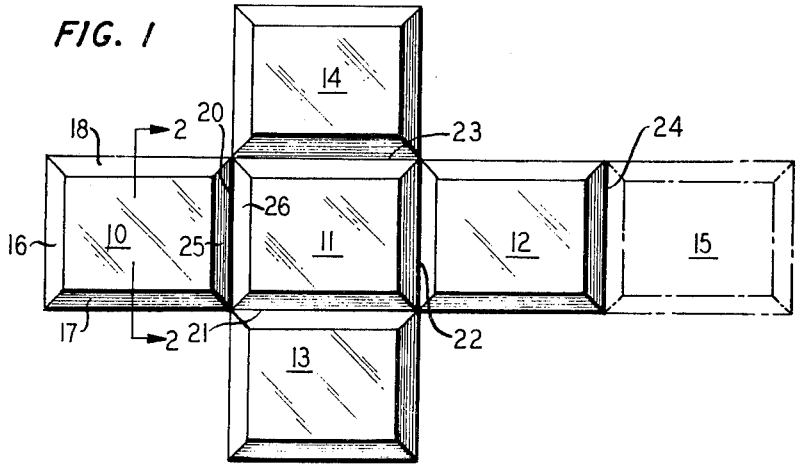
FIG. 1 is a perspective view of the invention.
Figure 3:
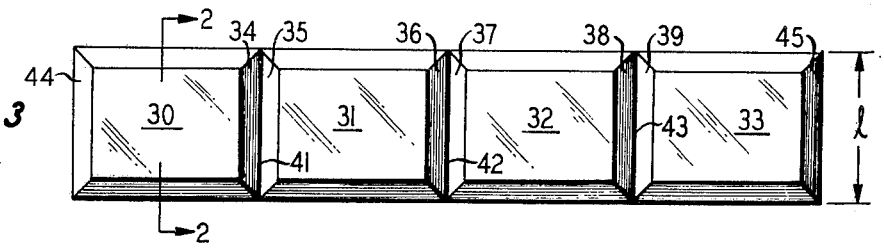

FIG. 1 shows the paint roller pan 10 with a bottom section or portion 12 having at one end 14 an end wall 16. Connecting with the bottom section 12 and the end wall 16 are two side walls 18 and 20. Located adjacent the other end 22 of the bottom section 12 is a leg member 24 which is hollow and has an opening 26 at its upper end to establish a reservoir or receptacle 28.

Figure 2:
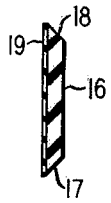
FIG. 2 is a sectional view taken along the lines 2—2 in FIG. 1.
Figure 4:
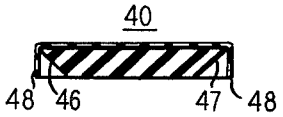
Figure 5:
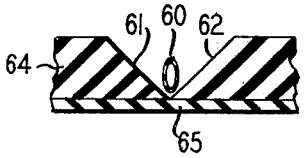
Figure 6:
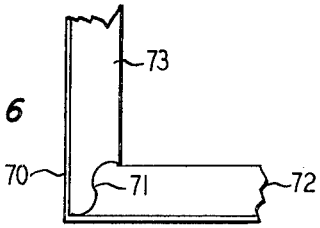
Figure 1:
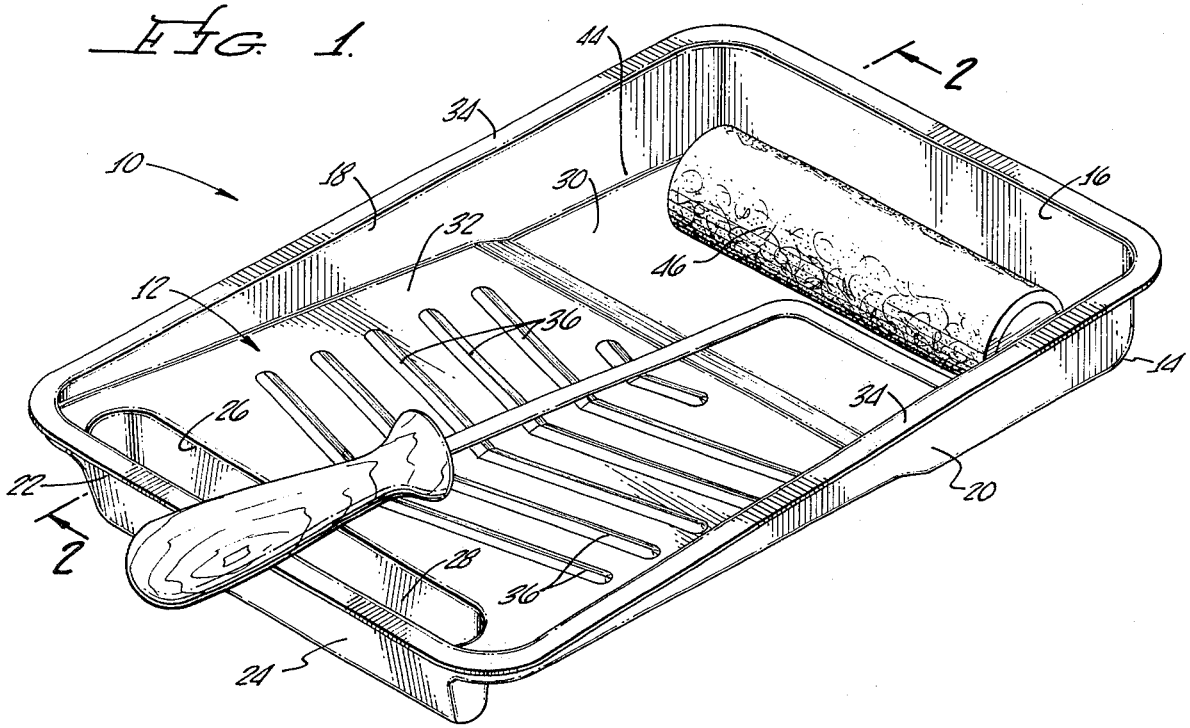
Figure 2:
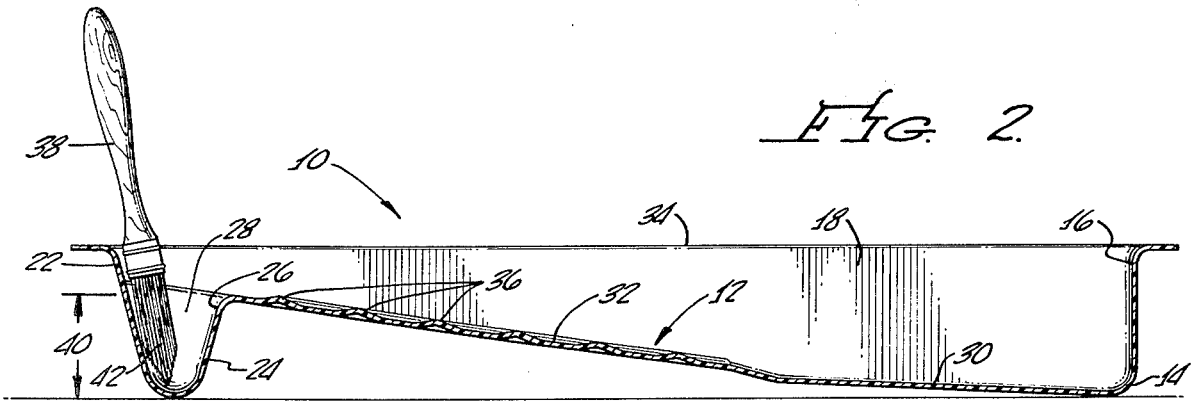

As shown more clearly in FIG. 2, adjacent the one end 14 at the bottom section 12 is a flat section 30 where most of the paint for a paint roller is placed. Extending up from the flat section 30 is an inclined surface 32 of the bottom section 12 which slopes upward to a position adjacent upper edge 34 of the side walls 18 and 20. Located on the inclined surface 32 are a series of ribs 36 which are used to more evenly spread the paint over the surface of the paint roller and to strengthen the surface 32.

Formed within the other end 22 of the bottom surface 12 is a reservoir or paint well 28 which establishes the leg 24. The depth 40 of the paint well 28 is sufficient to hold the paint brush 38 in a position similar to that shown in FIG. 2. This prevents the paint brush from falling out of the roller pan. In addition, the depth 40 of the paint well 28 allows for the holding of a sufficient amount of paint, so that when the paint brush 38 is introduced to the paint, a sufficient portion of the bristles 42 is covered with paint easily for application to a work surface. On the other hand, when the well 28 is full a typical brush in the well will not be submerged above the bristles.

With respect to FIG. 1, the end wall 16 and the side walls 18 and 20 form in conjunction with the flat surface 30 and the inclined surface 32 a reservoir 44 which receives paint for use by the paint roller 46.

Turning to the operational use of the paint roller pan 10, when a supply of paint is placed within the reservoir 44, the paint roller 46 is dipped into the reservoir 44 to receive the necessary amount of paint. Then the roller is rolled back and forth on the inclined surface 32 over the protruding ribs 36 to allow a more even distribution of the paint over the roller surface. When painting with the roller is temporarily completed on the work surface, the roller is again placed in the roller pan 10 as shown in FIG. 1. From the above discussion it is to be noted that it is necessary to maintain the inclined surface 32 at some incline to the horizontal or flat surface 48 in order to contain the paint supply within the reservoir 44. The surface 32 is inclined to keep a certain amount of the surface 32 free of the supply of paint, so that the roller may be rolled along that surface on the ribs 36 to more evenly spread the paint on the roller.

Having placed a paint supply in the reservoir 28, a painter can dip the brush 38 into the paint reservoir 28 to receive a sufficient amount of paint on the bristles 42 in order to perform the work necessary in the areas where the paint roller was unable to apply the paint. After the touch-up work has been completed with the brush 38, the brush 38 can be again inserted within the reservoir 28 for temporary storage to prevent the brush from accidentally getting paint on undesirable areas. The reservoir 28 also acts as the leg 24 which maintains the inclined surface at an incline with respect to the horizontal surface 48, so that the functions of the inclined surface as discussed above are fulfilled.

It is envisioned that this paint roller pan design will be made or formed, for example by vacuum forming, from a thin plastic material for use either as a self sufficient paint roller pan or as a liner to be used in a more sturdy frame. When used as a liner or as a separate pan itself, the pan can be made disposable in order to alleviate the operator of the need for cleaning. The forming process will make the pan from a single sheet of plastic material with the reservoir 44 and the paint well 28 being integrally formed therein.

What is claimed is:

1. A paint roller pan comprising:

a bottom section having an inclined area;

an end wall extending up from the lower end of said bottom section;

a pair of side walls extending up from the respective sides of said bottom section, said end wall and said pair of side walls in conjunction with said bottom section forming a paint receptacle which is relatively deep at one end and relatively shallow at the other end and is of sufficient width for receiving a typical paint roller and of sufficient length to permit the roller to be rolled a substantial distance along the inclined area of the bottom section; and a leg integrally connected to said bottom section at the shallow end and extending generally parallel to said end wall, said leg maintaining said bottom section inclined relative to the flat support surface on which the pan rests, said leg being hollow with an opening forming a paint brush reservoir for receiving a typical paint brush used to do touch-up work in conjunction with the use of said paint roller, said paint brush reservoir being substantially smaller than said paint roller reservoir, allowing said inclined surface to extend along substantially the entire length of said pan.

2. A paint roller pan comprising:

a bottom section having an inclined area;

an end wall extending up from the lower end of said bottom section;

a pair of side walls extending up from the respective sides of said bottom section, said end wall and said pair of side walls in conjunction with said bottom section forming a paint receptacle which is relatively deep at one end and relatively shallow at the other end and is of sufficient width for receiving a typical paint roller and of sufficient length to permit the roller to be rolled a substantial distance along the inclined area of the bottom section; and a leg integral with said bottom section at the shallow end, said leg maintaining said bottom section inclined relative to a flat support surface on which the pan rests, said leg being hollow with a top opening forming a paint brush reservoir of receiving a typical paint brush used to do touch-up work in conjunction with the use of said paint roller, said paint brush reservoir being substantially smaller than said paint roller reservoir. Allowing said inclined surface to extend along the major portion of the length of said pan.

3. A disposable paint roller tray comprising:

a bottom section having a general inclined surface;

a pair of side walls extending up from said bottom section, said side walls being of greater height adjacent one end of said bottom section;

an end wall extending up from said one end of said bottom section, said pair of side walls with said bottom section and said end wall forming a receptacle having a relatively deep portion at said one end and a relatively shallow portion at the other end for paint to receive a roller; and at least one leg formed in the other end of said bottom section, said leg being hollow and open at its upper end forming a paint well within said receptacle and considerably smaller than said receptacle for receipt of a paint brush, said leg maintaining said bottom section inclined with respect to the horizontal, said paint well being large enough to receive said paint brush while being small enough in one direction to keep said paint brush from falling onto said inclined surface or out of said tray.

* * * * *